US005964411A

United States Patent [19]

McGuffie

[11] Patent Number: 5,964,411

[45] Date of Patent: Oct. 12, 1999

[54] LINE MARKING HEAD ASSEMBLY AND LINE MARKING APPARATUS INCLUDING THE SAME

[76] Inventor: Iain Peter McGuffie, Hungry Hill Farm, Stoke Lacy, Nr Bromyard, Herefordshire HR7 4HD, United Kingdom

[21] Appl. No.: 08/952,143

[22] PCT Filed: Jun. 19, 1995

[86] PCT No.: PCT/GB95/01434

§ 371 Date: Nov. 11, 1997

§ 102(e) Date: Nov. 11, 1997

[87] PCT Pub. No.: WO96/36409

PCT Pub. Date: Nov. 21, 1996

[30] Foreign Application Priority Data

May 15, 1995 [GB] United Kingdom ..... 9509808

[51] Int. Cl.[6] ..... B05B 1/28

[52] U.S. Cl. ..... 239/164; 239/150

[58] Field of Search ..... 239/164, 165, 239/166, 150; 222/608

[56] References Cited

U.S. PATENT DOCUMENTS

| | | | |
|---|---|---|---|
| 2,812,211 | 11/1957 | Gardner | 239/150 |
| 3,625,428 | 12/1971 | Mecklin | 239/166 |
| 3,687,371 | 8/1972 | Swager . | |
| 3,796,353 | 3/1974 | Smrt | 239/150 X |
| 3,807,634 | 4/1974 | Vogt | 239/150 |
| 4,053,108 | 10/1977 | Hofmann | 239/150 |
| 4,618,016 | 10/1986 | Van Der Lely | 180/53.6 |
| 4,768,715 | 9/1988 | Sali et al. | 239/166 |
| 4,784,324 | 11/1988 | DeWitt et al. | 239/165 |
| 4,893,751 | 1/1990 | Armstrong | 239/165 X |
| 5,302,207 | 4/1994 | Juricsin | 239/150 X |
| 5,368,232 | 11/1994 | Schroeder . | |

FOREIGN PATENT DOCUMENTS

| | | |
|---|---|---|
| 87063468 | 6/1987 | Germany . |
| 87138840 | 2/1988 | Germany . |

OTHER PUBLICATIONS

International Search Report

*Primary Examiner*—Andres Kashnikow
*Assistant Examiner*—Sean P. O'Hanlon
*Attorney, Agent, or Firm*—Ira S. Dorman

[57] ABSTRACT

A head assembly for marking a line on a ground surface includes an outrigger structure adapted to be connected to a vehicle for movement over the ground surface, and a line-marking head connected to the outrigger structure. The outrigger structure is movable, in use, between a first position in which it deploys the line-marking head at an operational position which is offset to a side of the vehicle outside the bounds of the vehicle, and a second position in which it deploys the line-marking head at a retracted position which is inwardly of the operational position.

28 Claims, 3 Drawing Sheets

LINE MARKING HEAD ASSEMBLY AND LINE MARKING APPARATUS INCLUDING THE SAME

CROSS REFERENCE TO RELATED APPLICATION

Figure 1:
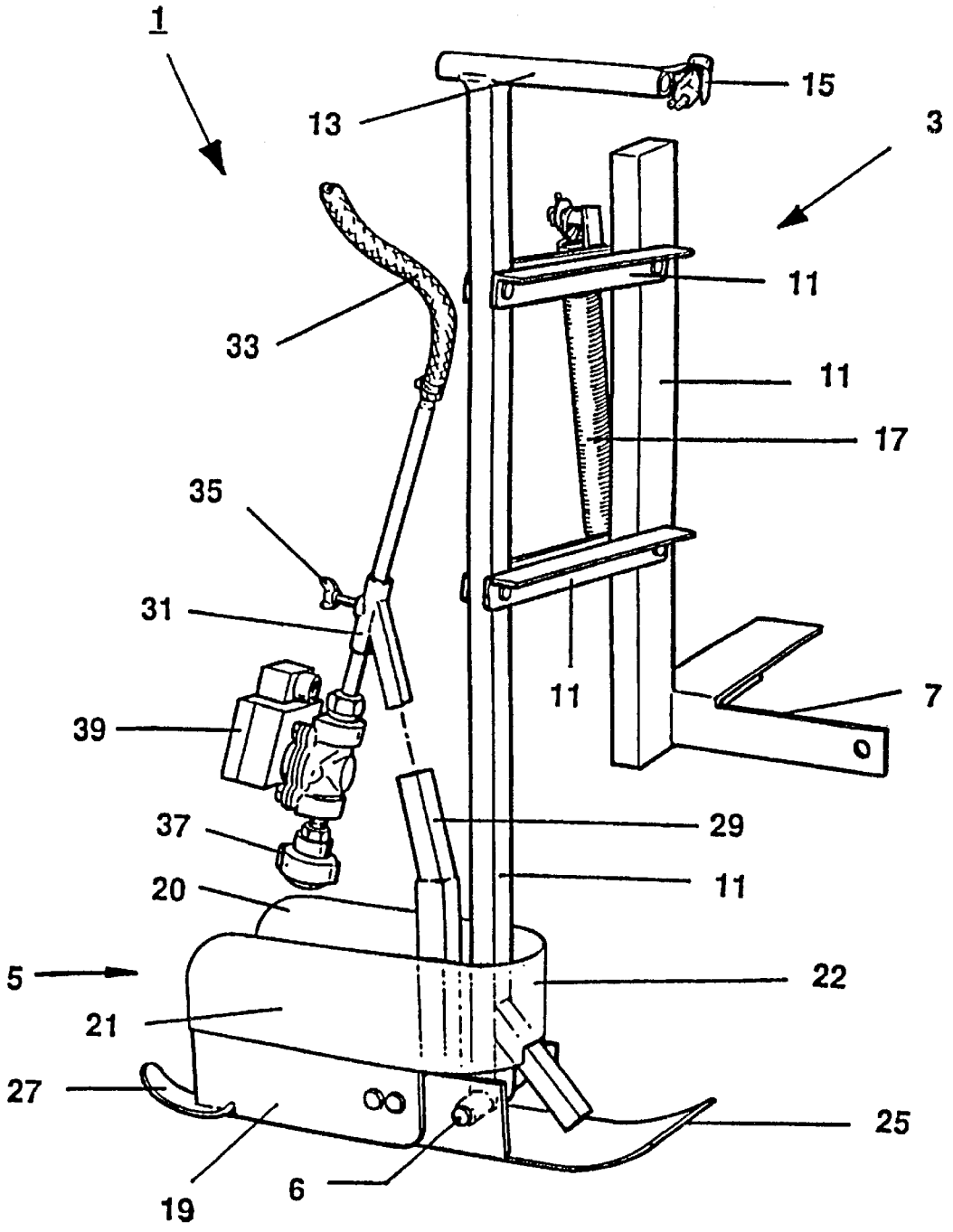

This application claims the benefit, under 35 USC 371, of PCT/GB95/01434, filed Jun. 19, 1995.

The present invention relates to line marking apparatus which incorporates a line marking head for marking a line on a ground surface, the apparatus comprising a vehicle for movement across the ground surface to which the line marking head is connected. The invention is particularly, but not exclusively, concerned with the use of a line marking apparatus comprising a wheeled vehicle having a power source such as an internal combustion engine for driving some or all of the wheels of the vehicle.

Line marking heads hitherto connected to line marking vehicles have suffered the drawback that they have required the vehicle to be manoeuvred from the path taken thereby for generating a line on a ground surface when an obstacle is encountered on the axis of the line to enable the line marking head to be repositioned on the downstream side of the obstacle. Examples of such obstacles are goal posts on the boundary lines of football and rugby pitches.

It is the aim of the invention to provide means for enabling a line marking vehicle to pass an obstruction on the axis of a line being marked without the vehicle having to be deflected from its direction of travel for marking the line.

According to the present invention there is therefore provided a line marking apparatus comprising a vehicle for movement across a ground surface to be marked with a line, an outrigger structure connected to the vehicle, and a line marking head connected to the outrigger structure, the outrigger structure being movable between a first position in which the line marking head is deployed at an operational position which is offset to a side of the vehicle outside the bounds of the vehicle and a second position in which the line marking head is deployed at a retracted position located inwardly of the operational position relative to the vehicle, wherein the outrigger structure is pivotably mounted on the vehicle so as to be movable between the first and second positions in a plane which is perpendicular or substantially perpendicular to the ground surface and so as to cause the line marking head to move in a plane perpendicular or substantially perpendicular to the direction of movement of the vehicle on the ground surface.

In an embodiment of the invention hereinafter to be described the outrigger structure adopts an expanded configuration in its first position and a contracted configuration in its second position.

In an embodiment of the invention hereinafter to be described the outrigger structure comprises a plurality of interconnecting arms which define a parallelogram linkage for moving the outrigger structure between the first and second positions with the arms of the parallelogram linkage extending in a plane substantially perpendicular to the direction of movement of the vehicle. For ease of construction the arms of the parallelogram linkage can extend in the plane of retraction of the line marking head.

In an embodiment of the invention hereinafter to be described securing means are provided for releasably securing the outrigger structure in the first and second positions. For example, the securing means can comprise a spring.

In an embodiment of the invention hereinafter to be described the outrigger structure is manually actuatable to move it between the first and second positions.

In an embodiment of the invention hereinafter to be described the line marking head is disposed within the bounds of the vehicle when in its retracted position.

In an embodiment of the invention hereinafter to be described the line marking head contacts the ground surface when in its operational position. To facilitate movement across the ground surface the line marking head can be pivotally connected to the outrigger structure.

In an embodiment of the invention hereinafter to be described the line marking head has an outer cover member comprising a pair of spaced apart side walls which extend in a direction substantially parallel to the direction of travel of the vehicle to define a line marking channel and a transverse wall portion which connects the forward edges of the side walls. For convenience, the spacing of the side walls may be adjustable. Alternatively, the line marking head is detachably connected to the outrigger structure to enable another head with side wall portions of different spacing to be connected to the outrigger structure.

In an embodiment of the invention hereinafter to be described the forward edges of the side wall portions of the outer cover member support a forwardly extending sole plate which contacts the ground surface when the line marking head is in its operational position. To prevent digging into the ground surface the forward edge of the forwardly extending sole plate projects upwardly from the ground surface. A pair of spaced apart rearwardly extending sole plates which contact the ground surface when the line marking head is in its operational position can also be supported by the rear edges of the side wall portions of the outer cover member. As with the forward edge of the forwardly extending sole plate, the rear edges of the rearwardly extending sole plates preferably project upwardly from the ground surface to prevent digging into the ground surface.

In an embodiment of the invention hereinafter to be described coupling means are provided for releasably coupling the line marking head with a supply of line marking material.

In an embodiment of the invention hereinafter to be described the coupling means is adapted to releasably couple the line marking head with the nozzle of a line marking liquid supply line.

In an embodiment of the invention hereinafter to be described the nozzle generates a fantail output and height adjustment means are provided to enable the height of the nozzle relative to the ground surface when the line marking head is in its operational position to be adjusted.

In an embodiment of the invention hereinafter to be described regulating means are provided for regulating the flow of line marking material supply onto the ground surface. For example, the regulating means regulates a solenoid activated valve in the supply path.

In an embodiment of the invention hereinafter to be described the line marking head is connected to a side of the vehicle.

In an embodiment of the invention hereinafter to be described the vehicle is provided with means for carrying a user of the apparatus with the vehicle being a wheeled vehicle with a power source for driving some or all of the wheels to move the vehicle across the ground surface.

In an embodiment of the invention hereinafter to be described the line marking head is located near to the non-steering axle of the wheeled vehicle to minimise the effect of steering wobble on the line marking head.

In an embodiment of the invention hereinafter to be described the power source is adapted to pump the line marking material from the supply to the line marking head.

In an embodiment of the invention hereinafter to be described the wheels comprise low ground pressure tyres. This prevents soil compaction when the ground surface to be marked is grass or the like.

In an embodiment of the invention valve means are provided which regulate the flow of line marking material from the line marking head to the ground speed of the vehicle.

Figure 2:
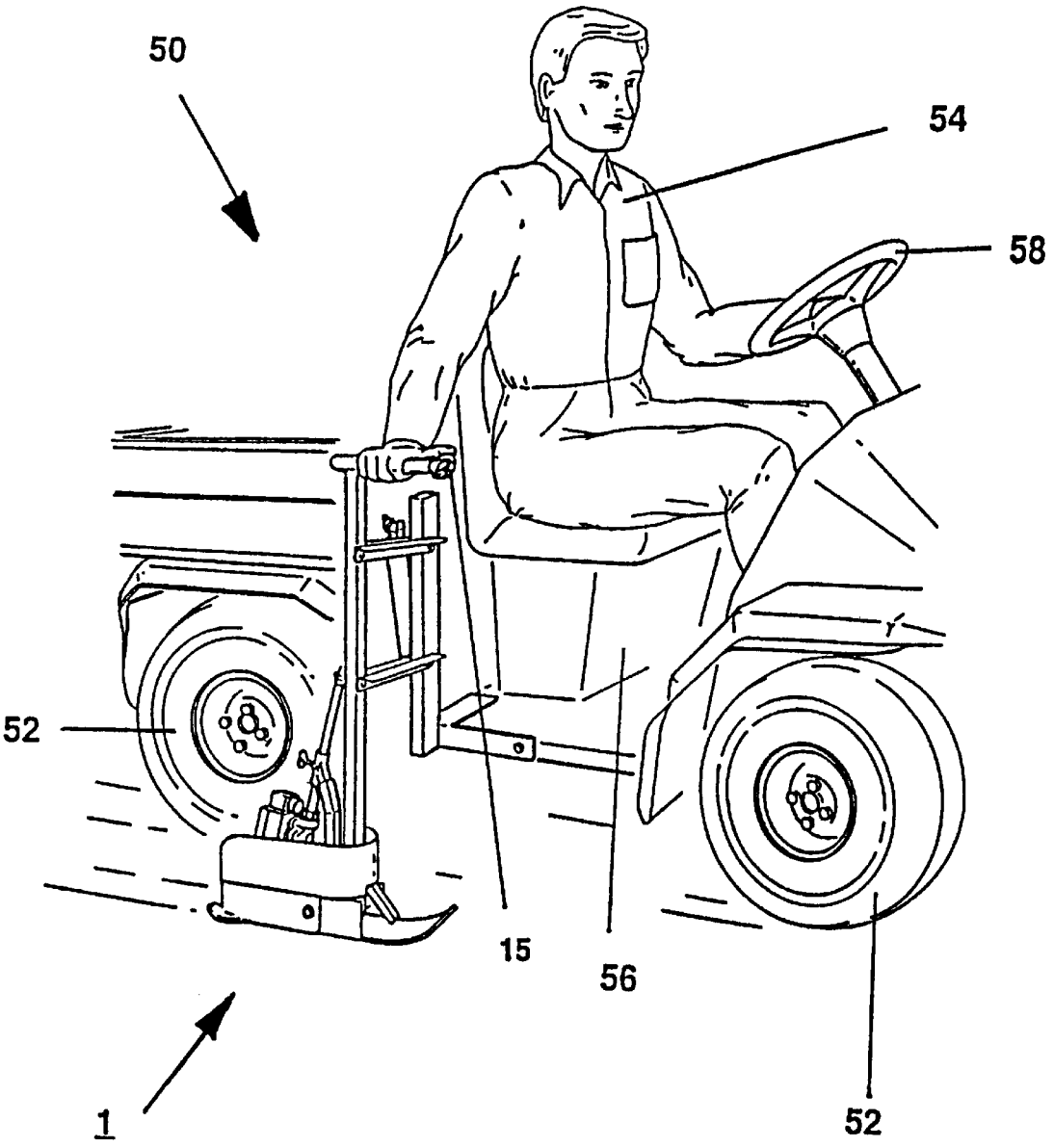
Figure 3B:
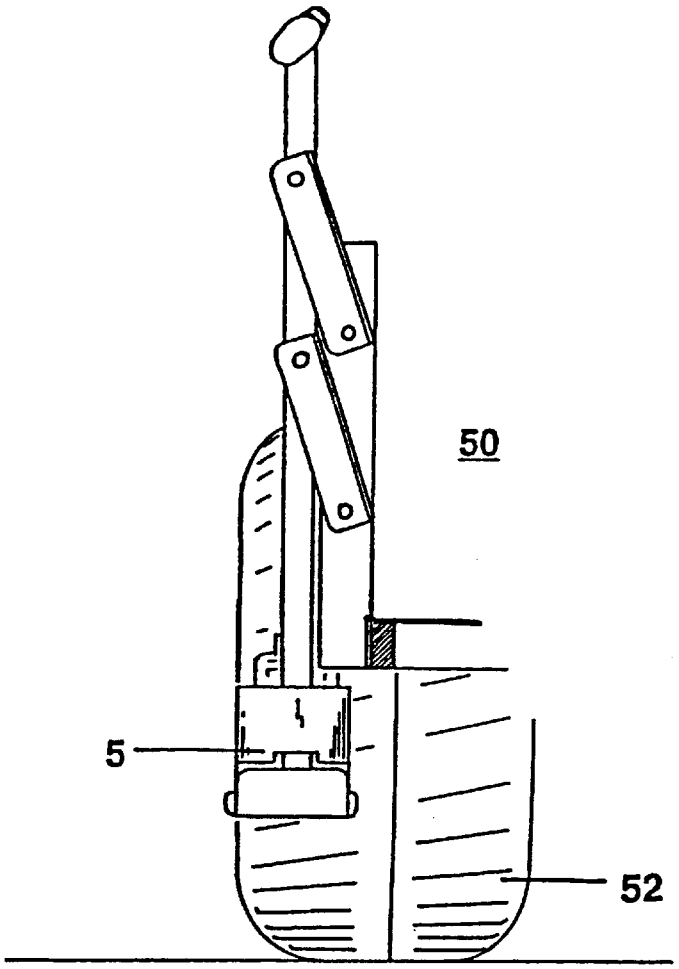
Figure 3A:
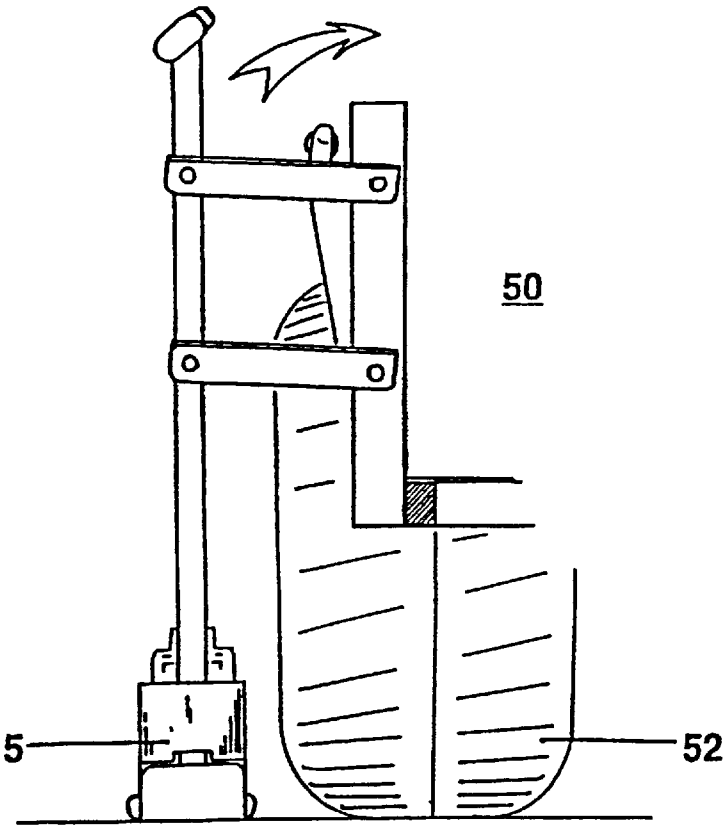

For a better understanding of the invention an exemplary embodiment will now be described with reference to the accompanying drawings in which:

FIG. 1 is a schematic side view from in front of a line marking head assembly forming part of a line marking apparatus in accordance with the invention, FIG. 2 is a schematic side view of a vehicle to which the line marking head assembly of FIG. 1 is connected, FIG. 3A is a scrap front view of the vehicle of FIG. 2 showing the line marking head of the assembly in the operational position, and FIG. 3B is a scrap front view of the vehicle of FIG. 2 showing the line marking head of the assembly in the retracted position.

In FIG. 1 there is shown a line marking head assembly 1 comprising an outrigger structure 3 and a line marking head 5 pivotally connected to the outrigger structure 3 at pivot point 6.

The outrigger structure 3 comprises a flange plate 7 for securing the outrigger structure 3 to a vehicle such as the one shown in FIG. 2. Depending from the flange plate 7 are a plurality of arms 11 which take the form of a parallelogram linkage. The parallelogram linkage enables the outrigger structure 3 to adopt the expanded configuration shown in FIGS. 1, 2 and 3A and the contracted configuration shown in FIG. 3B.

When the outrigger structure 3 adopts the expanded configuration the line marking head 5 is deployed outwardly at an operational position for line marking and when the outrigger structure 3 adopts the contracted configuration the line marking head 5 is deployed inwardly at a retracted position to enable an obstacle on the axis of the line being marked to be passed without manoeuvring of the vehicle.

In the illustrated embodiment the line marking head assembly 1 is such that the arms 11 of the parallelogram linkage extend in the plane of retraction of the line marking head 5. It will be realised, though, that such an arrangement is not essential to the successful operation of the invention. It will further be appreciated that instead of a parallelogram linkage the outrigger structure 3 could be a single arm adapted for pivotal connection to a vehicle.

The outrigger structure 3 presents an actuating handle 13 for manual movement of the outrigger structure 3 between its expanded and contracted configurations and consequent movement of the line marking head 5 between its operational and retracted positions and a spring 17 is provided to releasably hold the line marking head 5 in its two extreme positions. Hydraulic or electro/mechanical means would, however, be equally applicable for these tasks.

The line marking head 5 has a generally U-shaped outer cover member 19 which defines a line marking channel. The outer cover member 19 comprises a pair of spaced apart parallel side wall portions 20, 21 and a transverse wall portion 23 which connects the forward edges of the side wall portions 20, 21. One can see that the spacing of the side wall portions 20, 21 determines the width of the line marked. Conveniently, therefore, the spacing of the side wall portions 20, 21 may be adjustable for adjustment of the line width. Alternatively, the line marking head 5 may be detachably connected to the outrigger structure 3 to enable its replacement with another line marking head with side wall portions having a different spacing.

In its operational position the line marking head 5 contacts the ground surface which is to be marked with a line. To facilitate movement of the head 5 over the ground surface there is supported a forwardly extending sole plate 25 at the forward edge of the side wall portions 20, 21 of the outer cover member 19 and a pair of spaced apart rearwardly extending sole plates 27 (only one shown) at the rear edges of the side wall portions 20, 21. When the ground surface being marked is a grass surface the sole plates 25, 27 act to flatten the grass to provide improved line marking material deposition. To prevent the line marking head 5 digging into the ground surface on movement thereacross the leading edge of the forwardly extending sole plate 25 and the trailing edges of the rearwardly extending sole plates 27 are configured to project upwardly away from the ground surface.

The line marking head assembly of the invention is provided with means for coupling the line marking head 5 to a supply of line marking material. In the exemplary embodiment line marking liquid is supplied to the line marking head 5 through a supply line 33 with the outlet end of the supply line 33 being held by a screw 35 in a collar 31 for releasable securement in a post 29 carried by the line marking head 5.

The liquid is sprayed into the line marking head 5 through a nozzle 37 whose output takes the form of a planar fantail. The screw 35 allows the height of the nozzle 37 to be adjusted relative to the ground surface and a solenoid activated valve 39 is provided to regulate the flow from the nozzle 37 under the control of a switch 15 located on the handle 13. Alternatively, valve means may be provided which regulate the flow from the nozzle 37 to the ground speed of the vehicle to which the assembly 1 is connected.

Turning now to FIG. 2, there is shown the line marking head assembly 1 of FIG. 1 connected to a wheeled vehicle 50. For rapid marking of a line some or all of the wheels 52 of the vehicle 50 are driven by a power source carried by the vehicle 50 with the vehicle being steered through a steering wheel 58 by an operator 54 seated on a seat 56 mounted on the vehicle 50. When the ground surface to be marked with a line is grass or the like it is preferable that the wheels have low ground pressure tyres to prevent soil compaction. To this end, the Kawasaki MULE series of utility vehicles have been found by the Applicants to be satisfactory.

Although not shown, a supply of line marking liquid is supported on the rear of the vehicle 50 and a pump pumps the marking liquid through the supply line 33 to the nozzle 37. Pumping can be effected by the power source of the vehicle 50 or by an independent source.

As can be seen, the line marking assembly 1 is connected to one side of the vehicle 50 to apply an offset line in relation to the vehicle 50. The user 54 thus has good control of both the steering wheel 58 and the marking switch 15.

Movement of the line marking head 5 between the operational and retracted positions is in a plane perpendicular or substantially perpendicular to the direction of movement of the vehicle 50. Thus, when the user 54 is marking a line up to a goal post or similar object he can retract the line marking head 5 in order to continue on the same driving line of direction. The user 54 passes the obstacle with the line marking head 5 retracted and then extends the line marking head 5 to its operational position to mark on the same line and direction as before.

To help minimise the effect of steering wobble on the head 5 it has been found to be preferable to position the line marking head 5 near to the non-steering axle of the vehicle 50.

Although not shown, when the ground surface being marked is a grass surface the vehicle 50 may carry grass cutting means to cut the grass in front of the line marking head 5 to give improved line marking material deposition.

As can be seen from FIG. 3A, when the line marking head 5 is deployed in its operational position it falls outside the bounds of the vehicle 50. This ensures that the marked line is not overrun by the wheels 52 of the vehicle 50. Conversely, FIG. 3B shows that when the line marking head 5 is deployed in its retracted position the head 5 falls within the bounds of the vehicle 50. It will be understood, however, that for the aim of the invention to be realised it is only necessary for the line marking head 5 to be retracted sufficiently inwardly towards the vehicle 50 in a plane which is perpendicular or substantially perpendicular to the ground surface and preferably in a plane perpendicular or substantially perpendicular to the direction of travel of the vehicle 50.

That is to say, the head 5 could still fall outside the bounds of the vehicle 50 in its retracted position provided it is disposed sufficiently inward of the operational position to enable the vehicle 50 to pass an obstruction on the axis of the line being marked without having to be deflected from the course it is following to mark the line.

I claim:

1. Line marking apparatus comprising a vehicle for movement across a ground surface to be marked with a line, an outrigger structure connected to the vehicle, and a line marking head connected to the outrigger structure, the outrigger structure being movable between a first position in which the line marking head is deployed at an operational position which is offset to a side of the vehicle outside the bounds of the vehicle and a second position in which the line marking head is deployed at a retracted position located inwardly of the operational position relative to the vehicle, wherein the outrigger structure is pivotably mounted on the vehicle so as to be movable between the first and second positions only in a plane which is substantially perpendicular to the ground surface and so as to cause the line marking head to move in a plane substantially perpendicular to a direction of movement of the vehicle on the ground surface.

2. An apparatus according to claim 1, wherein the outrigger structure adopts an expanded configuration in its first position and a contracted configuration in its second position.

3. An apparatus according to claim 2, wherein the outrigger structure comprises a plurality of interconnecting arms which define a parallelogram linkage for moving the outrigger structure between the first and second positions with the arms of the parallelogram linkage extending in a plane substantially perpendicular to the direction of movement of the vehicle.

4. An apparatus according to claim 3, wherein the arms of the parallelogram linkage extend in the plane of retraction of the line marking head.

5. An apparatus according to claim 1, wherein securing means are provided for releasably securing the outrigger structure in the first and second positions.

6. An apparatus according to claim 5, wherein the securing means comprises a spring.

7. An apparatus according to claim 1, wherein the outrigger structure is manually actuatable to move it between the first and second positions.

8. An apparatus according to claim 1, wherein the line marking head is disposed within the bounds of the vehicle when in its retracted position.

9. An apparatus according to claim 1, wherein the line marking head contacts the ground surface when in its operational position.

10. An apparatus according to claim 9, wherein the line marking head is pivotally connected to the outrigger structure to facilitate movement across the ground surface.

11. An apparatus according to claim 1, wherein the line marking head has an outer cover member comprising a pair of spaced apart side walls which extend in a direction substantially parallel to the direction of travel of the vehicle to define a line marking channel and a transverse wall portion which connects the forward edges of the side walls.

12. An apparatus according to claim 11, wherein the spacing of the side walls is adjustable.

13. An apparatus according to claim 11, wherein the line marking head is detachably connected to the outrigger structure to enable another head with side wall portions of different spacing to be connected to the outrigger structure.

14. An apparatus according to claim 11, wherein the line marking head contacts the ground surface when in its operational position and wherein the forward edges of the side wall portions of the outer cover member support a forwardly extending sole plate which contacts the ground surface when the line marking head is in its operational position.

15. An apparatus according to claim 14, wherein the forward edge of the forwardly extending sole plate projects upwardly from the ground surface to prevent digging into the ground surface.

16. An apparatus according to claim 14, wherein a pair of spaced apart rearwardly extending sole plates which contact the ground surface when the line marking head is in its operational position are supported by the rear edges of the side wall portions of the outer cover member.

17. An apparatus according to claim 16, wherein the rear edges of the rearwardly extending sole plates project upwardly from the ground surface to prevent digging into the ground surface.

18. An apparatus according to claim 1, wherein coupling means are provided for releasably coupling the line marking head with a supply of line marking material.

19. An apparatus according to claim 18, wherein the coupling means is adapted to releasably couple the line marking head with a nozzle of a line marking liquid supply line.

20. An apparatus according to claim 19, wherein the nozzle generates a fantail output and height adjustment means are provided to enable the height of the nozzle relative to the ground surface when the line marking head is in its operational position to be adjusted.

21. An apparatus according to claim 18, wherein regulating means are provided for regulating the flow of line marking material supply onto the ground surface.

22. An apparatus according to claim 21, wherein the regulating means regulates a solenoid activated valve in the supply path.

23. An apparatus according to claim 1, wherein the line marking head is connected to a side of the vehicle.

24. An apparatus according to claim 1, wherein the vehicle is provided with means for carrying a user of the apparatus with the vehicle being a wheeled vehicle with a power source for driving at least some of the wheels to move the vehicle across the ground surface.

25. An apparatus according to claim 24, wherein the line marking head is located near to the non-steering axle of the wheeled vehicle to minimise the effect of steering wobble on the line marking head.

26. An apparatus according to claim 24, wherein the power source is adapted to pump the line marking material from the supply to the line marking head.

27. An apparatus according to claim 24, wherein the wheels comprise low ground pressure tyres.

28. An apparatus according to claim 1, wherein valve means are provided which regulate the flow of line marking material from the line marking head to the ground speed of the vehicle.

* * * * *